United States Patent [19]

Berggren

[11] 4,269,362

[45] May 26, 1981

[54] METHOD AND APPARATUS FOR BEATING FIBRE SLURRIES

[75] Inventor: Leif A. Berggren, Nässjö, Sweden

[73] Assignee: Torsten Lennart Berggren, Nässjö, Sweden

[21] Appl. No.: 59,164

[22] Filed: Jul. 20, 1979

[30] Foreign Application Priority Data

Aug. 7, 1978 [SE] Sweden ..... 7808423

[51] Int. Cl.[3] ..... B02C 7/04

[52] U.S. Cl. ..... 241/28; 241/261; 241/261.2

[58] Field of Search ..... 241/296, 261, 28, 261.3, 241/261.2, 251

[56] References Cited

U.S. PATENT DOCUMENTS

| | | | |
|---|---|---|---|
| 2,226,429 | 12/1940 | Hall | 241/261 |
| 2,306,857 | 12/1942 | Behnsen | 241/261 |
| 2,988,290 | 6/1961 | Merges | 241/261 |

*Primary Examiner*—Mark Rosenbaum

*Attorney, Agent, or Firm*—Frishauf, Holtz, Goodman & Woodward

[57] ABSTRACT

A method of beating fibre slurries, such as paper pulp, and lump-goods, such as wood-chips and shavings. The good are subjected to repeated, rapid pressure pulsations and working moments of short duration. This is obtained by causing the hydraulic pressure to increase during a compression phase with increasing internal frictional co-action between individual fibres, whereafter said hydraulic pressure is caused to fall momentarily during a following expansion phase.

9 Claims, 11 Drawing Figures

Fig 7.
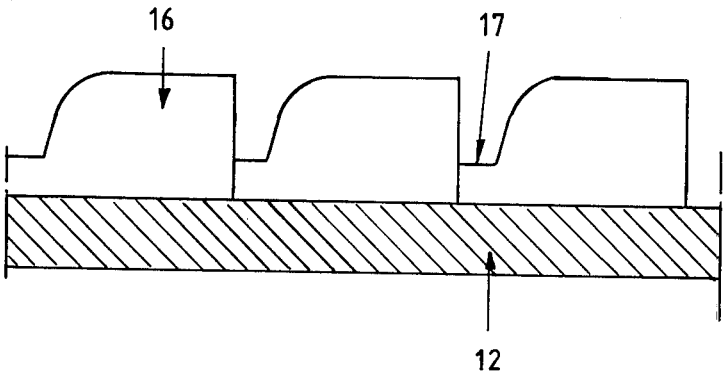
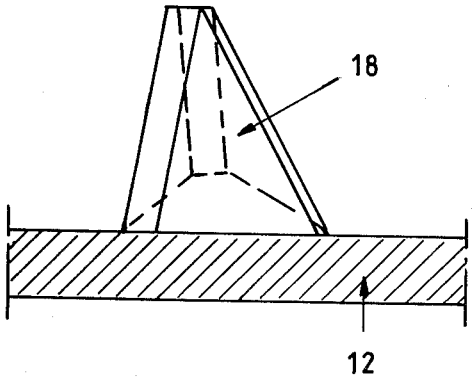
Fig 8.

METHOD AND APPARATUS FOR BEATING FIBRE SLURRIES

BACKGROUND OF THE INVENTION

The present invention relates to a method of beating fibre slurries, such as paper-pulp suspensions, and lump-goods, such as wood-chips and wood-shavings. The invention also relates to a beater for use in carrying out the method.

When manufacturing paper-pulp, it is necessary to beat the cellulose fibres in order that sufficient bonds are obtained in the lattice-structure between the various fibres in the resultant paper sheet. These bonds comprise hydrogen bonds between the molecular chains, and are mainly formed when the paper is de-watered and dried.

In the conventional beating of fibre slurries on a factory scale, changes are produced in the fibre structure, of which changes some are desirable while others result in negative side effects. In order to obtain a good binding ability, it is desirable that the primary wall and partly also the outer secondary wall of the fibre are peeled or stripped off, and that the internal hydrogen bonds are broken and replaced by hydrogen bonds between the fibre and the water. In this way the fibre is delaminated, takes up water, swells and becomes flexible. Further, external disintegration or loosening of the fibre wall is desired, which permits external fibrillation and foliation. In the majority of cases, however, the excessive crushing and cutting of the fibres obtained when using conventional beating or refining apparatus, is undesirable. In such conventional refining apparatus, the fibre material is worked mechanically against the edges and other surfaces of the beating means.

Thus, the main object of the present invention is to provide a method and a beating or refining apparatus with which the aforementioned disadvantages are eliminated and in which fibres are treated in a manner such as to break the internal hydrogen bonds of said fibres without clipping or crushing the same, said fibres being capable of absorbing water and swelling and becoming flexible.

SUMMARY OF THE INVENTION

In accordance with the present invention, this object is realized by subjecting the material to be refined to repeated, rapid pressure-pulsations and working moments of short duration, by causing the hydraulic pressure to increase during a compression phase with an increase in internal frictional coaction between individual fibres, whereafter said hydraulic pressure is momentarily decreased during a subsequent expansion phase.

The strong pressure pulsations and the intensive frictional co-action between individual fibres cause the tubular fibre-structure to collapse, the fibres to become flexible and the internal hydrogen bonds to be broken, said fibres absorbing water and swelling.

In accordance with the invention said pressure pulsations and working moments can be produced with the use of a disc refiner having a beater tackle so constructed that minor quantities of said material are enclosed in the spaces between tooth-like refining or beating means arranged in concentric rings on mutually opposing surfaces of the discs, said minor quantities of said material being subjected to an increasing pressure with an increase in internal frictional co-action between individual fibres, owing to the fact that said spaces successively decrease in volume when the teeth on said discs mesh with one another, whereafter a momentary decrease in pressure takes place as a result of an expansion of said spaces when said teeth completely pass from one another.

For the purpose of obtaining repeated changes of the direction of the substantially radial flow between the refiner discs, it is preferred that there is arranged between the teeth in each ring a bar which projects out from respective discs. Further, each tooth is conveniently defined laterally by arcuate lines which extend from the apex of a tooth to the rolling or pitch circles of the respective ring of teeth. In order to render discharge of the material being refined from said spaces more effective, each refiner disc is conveniently provided with at least one inner ring of teeth which extend in an opposite direction to the remaining teeth and which have steep, leading surfaces which form an angle with the radius of the respective disc suitable for said discharge of said material.

BRIEF DESCRIPTION OF THE DRAWINGS

FIG. 7 is a side view taken on the line X—X in FIG. 5.

FIG. 8 is a side view taken on the line Y—Y in FIG. 5.

DETAILED DESCRIPTION

The beating of cellulose fibres for the manufacture of paper pulp is carried out with the fibres slurried in water, mainly within two ranges of concentration, a low-concentration range of 2–6% and a high-concentration range of 25–40%. The useful energy when beating fibre slurries is extraordinarily low, and the efficiency of the beating process is far below 1%. Only a small part of the beating energy is absorbed by the fibres since, within the low-concentration range, the major part of said energy is consumed by the pumping-effect, turbulence and the cutting and crushing of the fibres, while within the high-concentration range the major part of said energy is consumed by elastic transformations and the generation of heat in the fibre material. An important factor when beating, however, is that the fibres must be able to take-up water and to swell, since the majority of the strength properties of the paper are dependent upon swelling of the fibres.

Further, it is desirable that the production of fines, i.e. small pieces of material, is restricted, since this fine-fraction will impair draining of the water from the fibre slurry on the paper-making machine and reduce the tear strength of the resultant paper. When beating said fibres, it is also of great importance that the effect on the fibre material is as homogeneous as possible, since heterogenous beating results in high-energy consumption and lower strength properties of the resultant paper.

Figure 1:
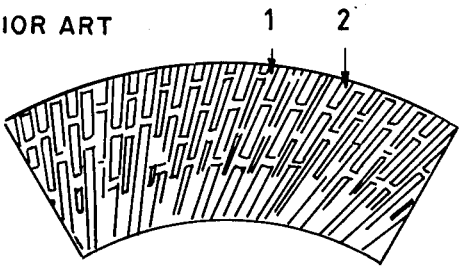
Fig 1 PRIOR ART
FIG. 1 is a plan view of a conventional beating segment provided with bars and grooves of the kind used in disc refiners.
Figure 2:
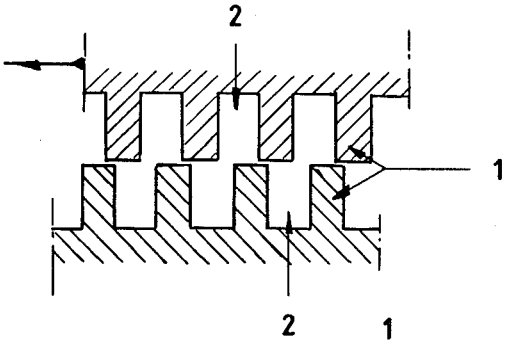
Fig 2 PRIOR ART
FIG. 2 is a part sectional view in larger scale of two refining discs having a beating segment according to FIG. 1.
Figure 3:
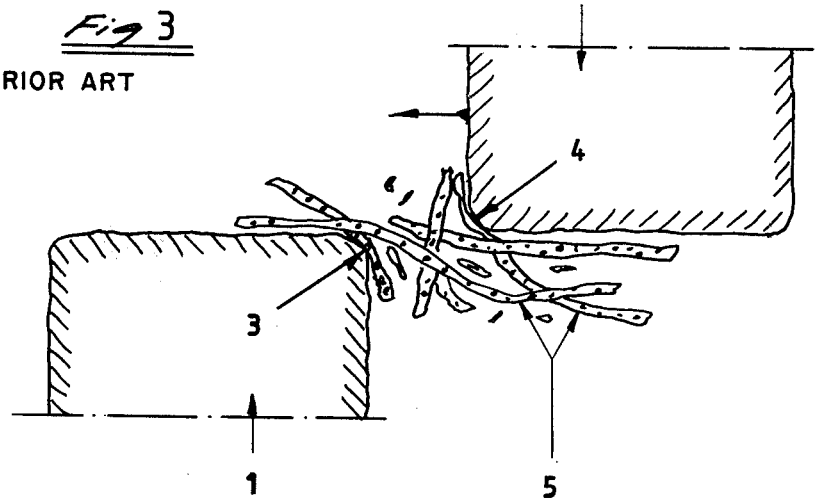
Fig 3 PRIOR ART
FIG. 3 illustrates in still larger scale two mutually approaching bars of the sections shown in FIG. 2 with fibres lying therebetween.

In the case of existing beating apparatus of conventional mills for beating paper-pulp, the beater tackle is constructed in accordance with the basic concepts of using bars and grooves. One such known construction is illustrated in FIGS. 1–3, in which the reference numeral 1 identifies the bars of said tackle, while the reference numeral 2 identifies the grooves intermediate of respective bars. Since the mode of operation is slightly different in the case of low pulp-concentrations than in the case of high pulp-concentrations, both cases will be hereinafter described.

In the case of low pulp-concentrations, large quantities of water are present in the beating zone, and hence the pulp has a low viscosity, the friction between contacting fibres also being low. The space between the crests of respective bars 1 must therefore be kept small, e.g. in the order of magnitude of from 3 to 5 times the thickness of the fibres, corresponding to 0.1–0.2 mm. The majority of the work is effected at the mutually approaching edges 3,4 of the bars, see FIG. 3. For the sake of clarity, the fibres 5 have been illustrated in an exaggerated scale in FIG. 3.

Since said space between crests of respective bars must be very small, adjustments must be made at uniform intervals of time in order to compensate for wear, which wear, however, is unevenly distributed over the surface of the beating means. This means that the fibre material is already unevenly treated after only a short weartime. Certain parts of the material are subjected to excessively hard treatment, in which the fibres are squeezed apart, crushed or reduced to fragments, whereas other parts of the fibres pass through the beating zone more or less untreated. Thus, the refining effect is already considerably impaired when the beater has only been in use for a short period of time.

Thus, the refining of pulp of low concentrations results, inter alia, in a heterogenous working of the fibres, large quantities of fine material, and a high energy consumption as a result of hydraulic losses.

When working in the high concentration range of 25–30%, a minor quantity of free water is present between the fibres in the beating zone. This results in the formation of a coherent fibre-mat between the bars of the grinding tool, such mat having a thickness of about 0.5–1.0 mm. As a result of friction between the fibres themselves and between the fibres and the refining surfaces, large quantities of heat are generated in the beating zone. This inhibits the formation of hydrogen bonds and since only a minor quantity of water is present, swelling of the fibres is restrained with a reduction in the strength properties as a result thereof.

Thus, by way of summary, the refining of high pulp-concentration results in a fibre which is only suitable for a very small number of paper qualities. The strength of the paper product is low and the amount of energy consumed in the process is high.

When using a beater tackle according to the present invention energy can be saved and the negative effects on the fibres considerably reduced, and the desired properties of the fibres mentioned in the introduction optimized. Further, beating at concentrations where a more optimal quantity of water is present in the beating zone, in the order of magnitude of 10–25%, is made possible and working of the fibres by edges as illustrated in FIG. 3 avoided. This is achieved in accordance with the invention by subjecting the fibres to pressure pulsations such as to cause the fibre walls to collapse, and by the fact that working of the fibres is effected as a result of an intensive frictional co-action between individual fibres.

Thus, the invention is based on the concept of the advantages afforded by treating cellulose fibres within a concentration range of from 10 to 25%. Within this range, the fibre pulp is so coherent that further water is able to to depart when the pulp is compressed, thereby to create tensional forces in the fibre mass, which means that an autogenous beating effect can be obtained as a result of friction between the individual fibres. The residual amount of water, however, is sufficient to keep the temperature down in the beating zone, this being necessary in order that the fibres, subsequent to said treatment, are able to absorb water, swell and become flexible.

Figure 4:
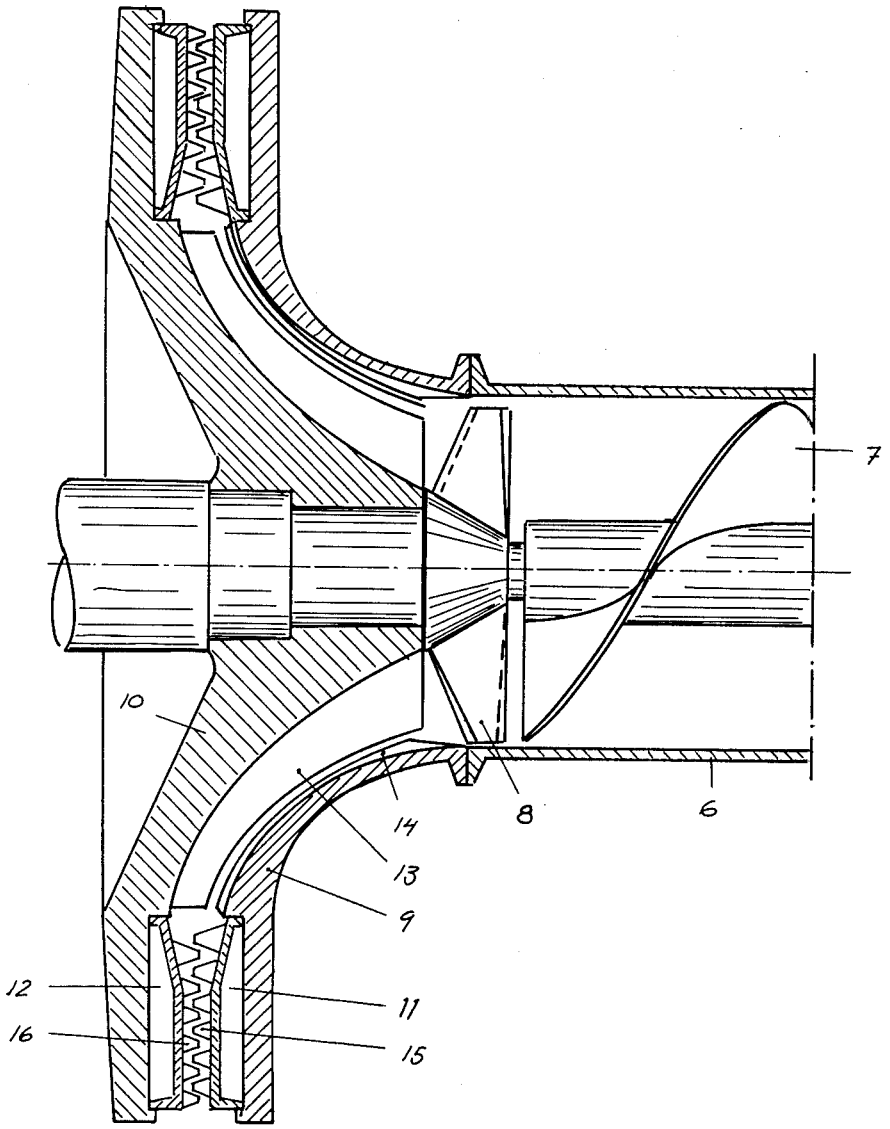
FIG. 4 illustrates a disc refiner provided with beating means according to the present invention.

FIG. 4 illustrates a disc refiner embodying the present invention. The illustrated refiner comprises an infeed tube 6 in which a feed screw 7 is arranged. The reference numeral 8 identifies a homogenizing propeller. Downstream of the propeller 8, the material to be refined is fed in between a stator 9 and a rotor 10, each of which is provided with a respective refining disc 11 and 12. Thus, the flow of said material is changed from an axial flow (through tube 6) to a radial flow (between rotor 10 and stator 9) before it reaches the spaces between the refining discs 11 and 12. During this change in its flow direction, said material is advanced by means of helical wings 13 arranged on the rotor 10, said wings co-acting with helical blades 14 arranged on the stator 9. The mutually facing surfaces of the discs 11 and 12 are provided with teeth-like beater or refining means 15 and 16, respectively. The shape and positioning of the teeth is clearly shown in FIGS. 5–8.

Figure 5:
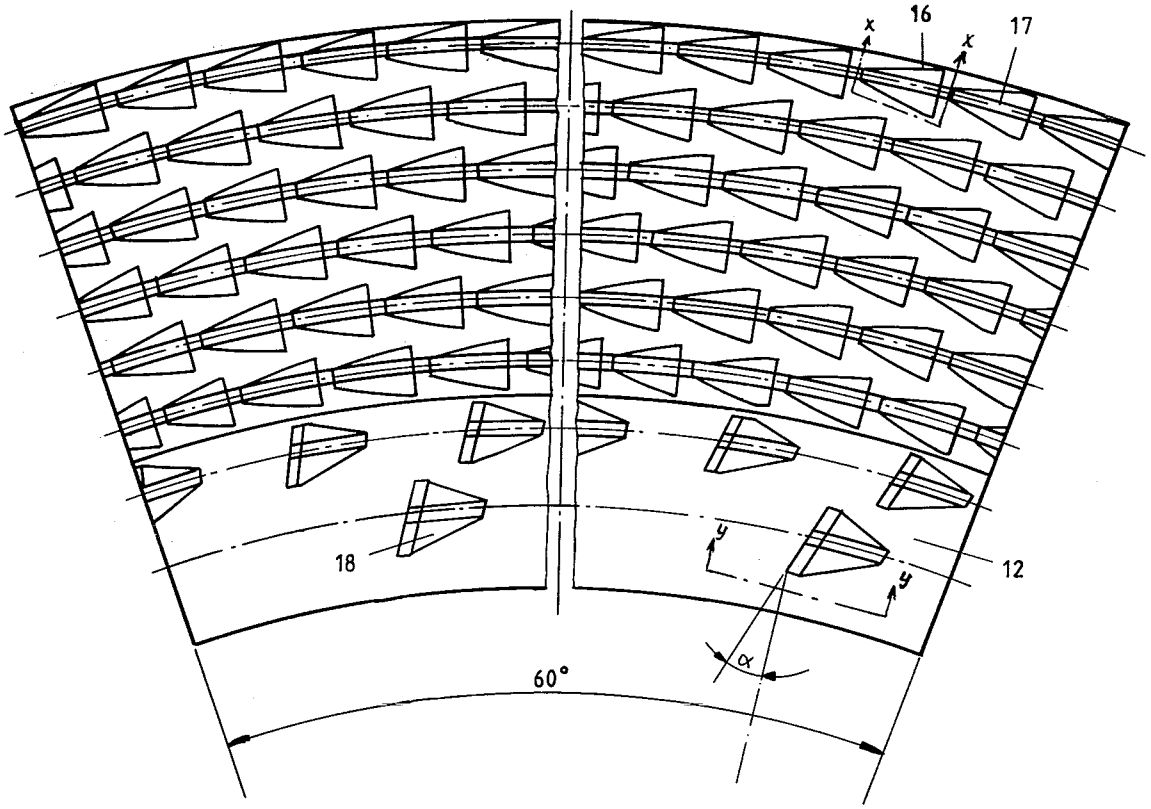
FIG. 5 is a plan view of a segment of a refining disc in the refiner shown in FIG. 4.
Figure 6:
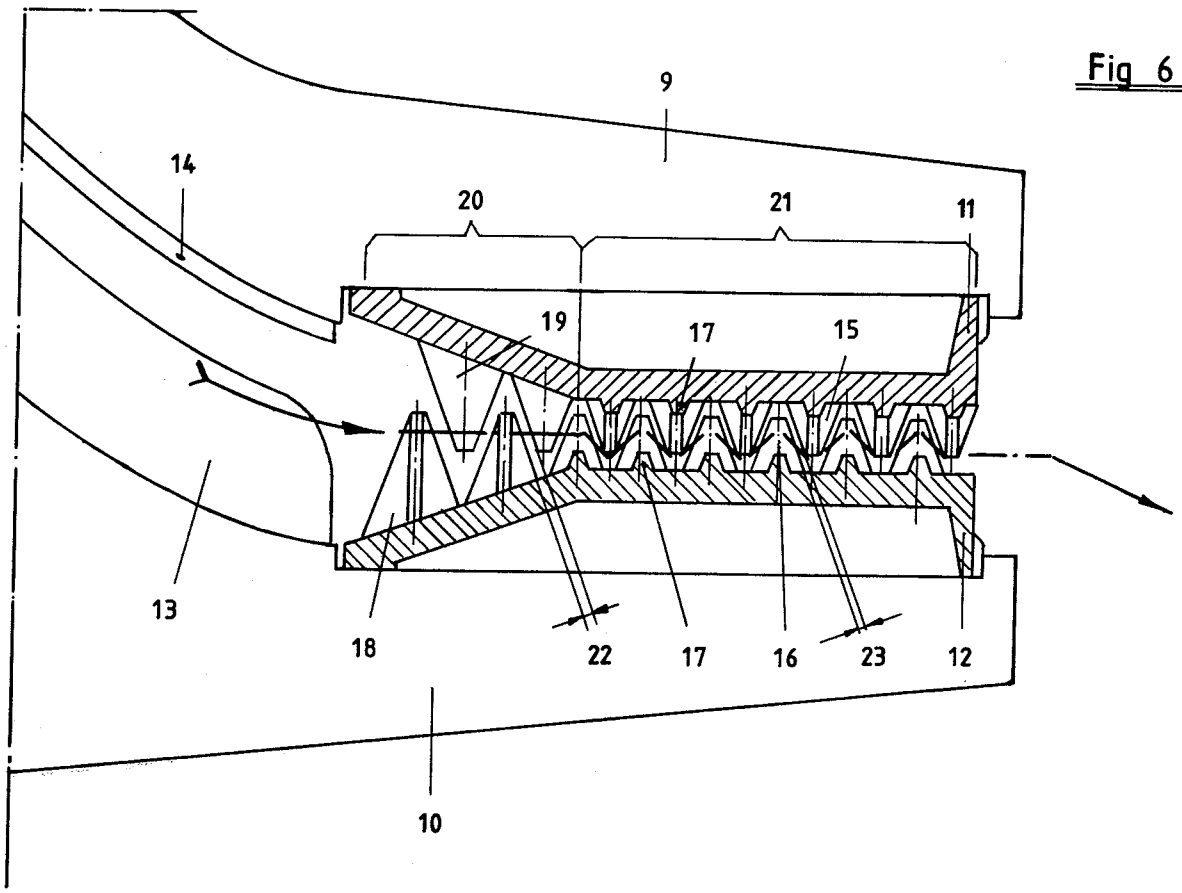
FIG. 6 is a sectional view of an external part of the disc refiner shown in FIG. 4.

As will be seen from FIG. 5, the teeth 16 on the disc 12 are arranged in concentric rings. This is also true of the teeth 15 on the disc 11. The teeth 15 and 16 are wedge shaped and have a thickness which decreases from the base thereof outwardly from respective discs. The leading, slightly rounded apex of the teeth extends in the direction of rotation of the respective disc as seen in FIG. 7. The concentric rings of teeth on the discs are arranged at such radial distances apart that the teeth on one ring of teeth on one disc project in between the teeth of two rings of teeth on an opposing disc, as illustrated in FIG. 6.

Each tooth is defined laterally by two arcuate lines which extend from the rounded apex of a respective tooth to the rolling circles of the ring of teeth in question. This form can be best seen from FIGS. 9–11. Located between the teeth of each individual ring is a bar 17 which projects out from the respective discs. As illustrated (see FIGS. 5–7), the bars 17 may be ring-shaped, the teeth being arranged over respective bars.

The purpose of the bars 17 is to deflect the radial flow of the material in the beater space, thereby to prevent said material from passing in a radial direction along the planar surfaces of a respective disc without being appreciably worked by the means teeth 15 and 16. As a result of the presence of the bars 17, the flow of material is repeatedly caused to change direction, as indicated by the dash line in FIG. 6, whereby all said material is subjected to exhaustive treatment.

The beater segment shown in FIG. 5 is provided with two inner rings of teeth 18 which extend in a direction opposite to the remaining teeth. Each of the teeth 18 forms an angle $\alpha$ with the radius of the beater disc 12, which means that the leading, transverse defining surface of a respective tooth provides an effective pump-feed of said material radially outwardly in the beater space between the refiner discs. The material to be refined is thus fed through the refiner by cooperation of the wings 13 and the blades 14, the centrifugal force created by the rotation, and the pumping action produced by the teeth 18 and of the corresponding teeth 19 of the other disc 11. This guarantees a continuous, smooth flow of material through the beater space.

As seen in FIG. 6, the, teeth 18 and 19 form a pre-treatment zone 20. Said teeth are of a more robust design than the other teeth and have a disintegrating and homogenizing effect on the material to be refined before it is fed into the actual treatment zone 21. In the zone 20, the gap 22 between the flanks of the teeth is considerably greater than the corresponding gap 23 in said treatment zone 21. The gap 23 is preferably maintained at about 0.2–0.6 mm and can be adjusted by axially displacing the rotor 10.

FIG. 7 is a side view taken on the line X—X in FIG. 5 of the teeth in the treatment zone 21 (FIG. 6). FIG. 8 is a corresponding side view taken on the line Y—Y in FIG. 5, showing a tooth 18 in the pre-treatment zone 20.

Figure 9:
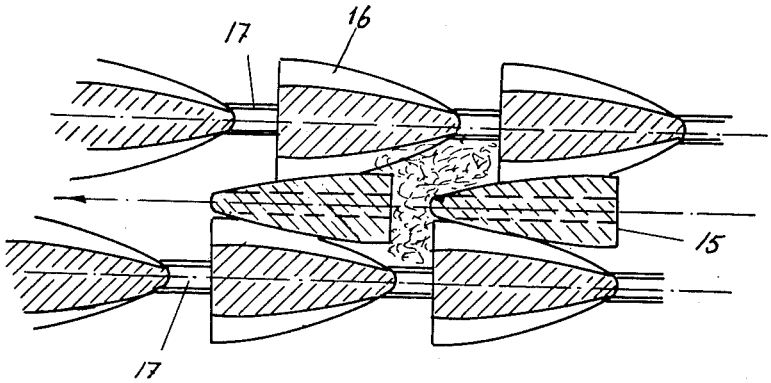
FIG. 9 illustrates how the teeth in a ring in the upper refining disc project in between the teeth of two mutually adjacent rings in the lower refining disc.
Figure 10:
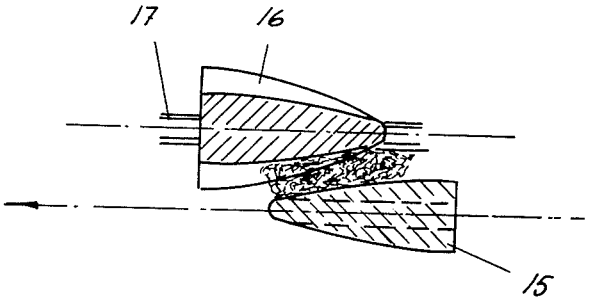
FIGS. 10 and 11 illustrate the passage between a tooth in the lower refining disc and a tooth in the upper refining disc.
Figure 11:
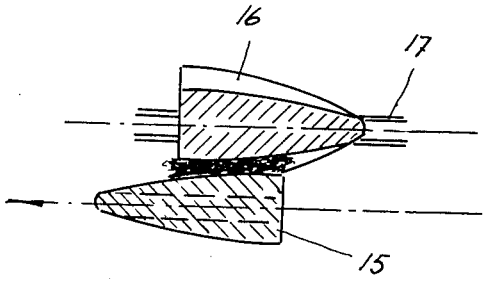

When the beating machine is in operation, compression zones and expansion zones are constantly formed when the rotor teeth and the stator teeth mesh with one another. For each expansion phase there is obtained intensive, internal frictional co-action between mutually contacting fibres. The sequence is illustrated schematically in FIGS. 9–11. FIG. 9 shows how two rings of teeth 16 of the rotor 12 mesh with two teeth 15 on the stator 11. When two teeth 15 and 16 meet, as shown in FIG. 10, the hydraulic pressure increases in the volume of suspension enclosed in the wedge-shaped space between the inclined flanks of the teeth and the bars 17. In the position illustrated in FIG. 11, a considerable increase in pressure is obtained as a result of a decrease in the size of said space, there being obtained intensive, internal frictional co-action between mutually contacting fibres, in a manner such as to soften the same. In a later stage, not illustrated, when the rear flank of respective teeth on one disc pass the rear flanks of the other teeth of the other disc, there is obtained a momentary drop in pressure, which contributes to a collapse of the fibre wall.

As previously mentioned, treatment of fibre material with this kind of beater tackle is preferably effected at pulp concentrations within the range of 10–25%. The viscosity is thus so high that the fibre suspension forms a coherent fibre network, which is subjected to repeated, effective treatment between the flanks of the teeth. With a refining disc having a diameter of about 700 mm and a rotary speed of 1450 r.p.m., the radially flowing fibre layer is subjected to about 350,000 compression and expansion phases with intermediate working moments per second. This provides for effective beating of the fibres without the aforementioned undesirable crushing and cutting thereof between sharp edges as obtained when working in accordance with known techniques. The teeth serving as beating means in accordance with the invention have no sharp edges, all surfaces co-acting with the fibres being rounded.

What is claimed is:

1. A method of beating a fibre slurry, such as paper pulp, and lump-goods, such as wood-chips and shavings, comprising subjecting said fibre slurry to repeated, rapid pressure pulsations and working moments of short duration, by (a) gradually compressing said fibre slurry down a compression stage by enclosing quantities of said fibre slurry in spaces of gradually decreasing volume to increase the hydraulic pressure on said fibre slurry during said compression stage and thereby increasing internal frictional co-action between individual fibres of said fibre slurry, but substantially without cutting or shearing said fibres; and thereafter (b) reducing momentarily said hydraulic pressure on said fibre slurry during an expansion phase which follows said compression stage; and then sequentially repeating steps (a) and (b) on said fibre slurry.

2. The method of claim 1, comprising causing said fibre slurry to pass substantially radially outwardly between two refining discs arranged to rotate in mutually opposite directions, wherein said pressure pulsations and said working sequences are effected by enclosing minor quantities of said fibre slurry between tooth-like beating means arranged in concentric rings of teeth on mutually opposing surfaces of said disc, said teeth of said rings of teeth being individual projections extending from a respective disc and having mutually inclined side surfaces, said minor quantities of said fibre slurry being subjected to said increasing pressure with an increase in internal frictional co-action between individual fibres as a result of a decrease in the size of the spaces in which said quantities are enclosed as the teeth of mating rings of teeth on respective discs mesh with one another and said mutually inclined surfaces coact to decrease the size of said fibre enclosing spaces, whereafter said momentary drop in pressure takes place as a result of an expansion of said spaces when said teeth completely pass out of engagement with one another substantially without cutting or shearing of said fibres.

3. The method of claim 1 or 2, wherein the concentration of said fibre slurry is maintained within a range of from about 10 to about 25%.

4. A beating machine for treating fibre slurries, such as paper-pulp, and lump-goods, such as wood-chips and shavings, comprising, at least two opposing beater discs arranged to rotate in mutually opposite directions relative to one another, and which form therebetween a substantially radially directed beater space through which said fibre slurry passes substantially outwardly from the center of said discs;

said discs being provided with tooth-shaped beater means extending therefrom into said beater space, said teeth of said beater means being arranged in concentric rings in a manner such that the teeth of one concentric ring of teeth on one disc project in between the respective teeth of two concentric rings of teeth on the other disc, said tooth-shaped beater means comprising wedge-shaped teeth spaced around the respective concentric rings, the narrowest end of said wedge-shaped teeth extending in the direction of rotation of the respective discs and said teeth having a thickness which decreases from the base of said teeth, said base being the portion of said teeth closest to the respective disc;

said concentric rings of teeth being arranged at such a distance apart in relation to the thickness of said wedge-shaped teeth and said teeth being shaped such that there is produced no cutting action between the teeth but there is obtained a considerable increase in pressure in each of a plurality of quantities of fibre slurry during the meshing of the respective teeth of opposing discs, said quantities of fibre slurry being confined between meshing wedge surfaces of said wedge-shaped teeth projecting upwardly from respective discs, thereby producing an intensive, internal frictional co-action between individual fibres as a result thereof, without a cutting action between the teeth, said pressure rapidly reducing after said teeth come out of mesh with each other.

5. The machine of claim 4, wherein said concentric rings each further comprise a plurality of bars projecting upwardly from a respective disc and arranged between the adjacent teeth in each respective ring.

6. The machine of claim 5 wherein said bars project outwardly of said discs a distance which is less than the height of the respective teeth.

7. The machine of claim 4 or 5, wherein the teeth have steep rear end surfaces.

8. The machine of claim 4 or 5 wherein each tooth is laterally defined by arcuate lines which extend from the apex of respective teeth out to the rolling circles of respective rings of teeth.

9. The machine of claim 4, wherein each of said discs is further provided with at least one inner ring of wedge-shaped teeth which extend and face in a direction opposite to the teeth of said other rings and which have a steep, leading end surface which forms an angle with the radius of the respective disc such as to obtain effective discharge of the goods to the beater space.

* * * * *